US005762717A

United States Patent [19]

Hugo et al.

[11] Patent Number: 5,762,717

[45] Date of Patent: Jun. 9, 1998

[54] PROCESS FOR CLEANING OIL-WETTED PARTS

[75] Inventors: Franz Hugo, Aschaffenburg; Erwin Wanetzky, Grosskrotzenburg; Albrecht Melber, Darmstadt; Manfred Raschke, Erlensee, all of Germany

[73] Assignee: Ald Vacuum Technologies GmbH, Erlensee, Germany

[21] Appl. No.: 664,834

[22] Filed: Jun. 17, 1996

[30] Foreign Application Priority Data

Jun. 17, 1995 [DE] Germany ..... 195 22 066.8

[51] Int. Cl.[6] ..... B08B 5/04

[52] U.S. Cl. ..... 134/21; 134/19

[58] Field of Search ..... 134/10, 19, 21, 134/25.1, 26, 40

[56] References Cited

U.S. PATENT DOCUMENTS

| | | | |
|---|---|---|---|
| 4,141,373 | 2/1979 | Kartanson | 134/21 |
| 5,205,857 | 4/1993 | Yokoyama | 75/401 |
| 5,401,321 | 3/1995 | Hugo et al. | 134/11 |
| 5,614,029 | 3/1997 | Nakatsukasa et al. | 134/5 |

FOREIGN PATENT DOCUMENTS

| | | |
|---|---|---|
| 554026 | of 1993 | European Pat. Off. . |
| 4240387 | of 1994 | Germany . |
| 4415093 | of 1995 | Germany . |
| 578875 | of 1993 | Japan . |

OTHER PUBLICATIONS

Derwent Abstract, Class M12, AN 95-273225, JP-A-07-173661.

Derwent Abstract, Class M24, AN 74-19098V, SU-A-384 947.

Mitten, "Vacuum Deoiling for Environmentally Safe Parts Cleaning", Metal Finishing, Sep. 1991, pp. 29-30.

AWT Publication, Umweltschutz Im Warmebehadlungs-Betrieb (1993).

ISPEN Publication (date unknown) "ECOVAC: Das Neuartige Oberflachenreiningungs-Und Entfettungs-System".

*Primary Examiner*—Scott W. Houtteman

*Attorney, Agent, or Firm*—Felfe & Lynch

[57] ABSTRACT

In a process for cleaning oil-wetted structural parts, a vacuum furnace (1) is first evacuated to a defined first pressure to eliminate residual air. Then an inert gas is introduced until a second, subatmospheric pressure is reached, which is above the first pressure, and the inert gas is circulated inside the vacuum furnace. To reduce the heat-up times and to conserve energy and inert gas:

(a) the second pressure is above the vapor pressure curve of the wetting oil and is reached by flooding the vacuum furnace (1);

(b) the inert gas feed and the evacuation are interrupted after the flooding, and the inert gas and the oil vapors are circulated exclusively in the interior of the vacuum furnace (1); and (c) upon completion of the heat-up period, a connection is established from the vacuum furnace (1) to a condenser (11) and to a vacuum pump (12); the pressure is lowered to a value below the vapor pressure curve; and the oils thus evaporated are withdrawn and condensed.

5 Claims, 2 Drawing Sheets

PROCESS FOR CLEANING OIL-WETTED PARTS

BACKGROUND OF THE INVENTION

The invention pertains to a process for the cleaning of oil-wetted structural parts in a vacuum furnace, which is first evacuated to an initial, predetermined pressure by means of a vacuum pump to eliminate as much of the residual air as possible. To accelerate the heating of the parts, an inert gas is then introduced until a second subatmospheric pressure, which is above the first pressure, is reached, the inert gas being circulated over the parts and a heat source. To evaporate the oils, the pressure is reduced to a value which is below the vapor pressure curve of the oil, so that the oils are evaporated and can then be condensed in a condenser.

Oil-wetted parts occur frequently in the intermediate stages of manufacturing processes. The oils or oil-containing fluids (emulsions) in question are, for example, coolants, which are used during machining and grinding processes, or hardening and quenching oils. These fluids must be removed in every case, because they not only interfere with the following machining processes but also cause disposal problems. Especially troublesome in this regard is the release of vapors in downline production systems such as hardening or tempering furnaces. In this case, it is not only possible for these furnaces to become contaminated but also for environmental toxins to be formed by the heat treatment.

It is known that intermediate cleanings can be carried out with alkaline cleaning agents or with solvents from the group of the chlorohydrocarbons, fluorochlorohydrocarbons, TRI, and PER. In all these cases, prolonged periods of use lead to accumulations of contaminated cleaning agents, which must then be disposed of by costly methods. In addition, the oils removed from the components by the cleaning process are lost to further use.

It is also known that oil-wetted or oil-saturated solids can be freed of oily residues by means of vacuum processes. For this purpose, the solids in question are introduced into a heatable vacuum chamber and gradually freed of the oils and greases under the action of decreasing pressures and increasing temperatures. Under certain conditions, individual fractions of the condensates can be recovered. This so-called vacuum distillation process turns out to be time-consuming, however, because it is difficult to achieve a heating rate which brings the material to be deoiled or degreased to a temperature sufficient for evaporation within an acceptable period of time. The time consumed might still be acceptable in cases where the material being deoiled or degreased is waste material of relatively low density such as oil filters or metal cans.

The slow heating rate associated with the use of a vacuum, however, represents a severe roadblock in the production process.

For example, it is too time-consuming to heat bulk material or packings of gear wheels, dies, etc., to a sufficiently high temperature at which the adhering oils can be evaporated at acceptable cost.

A process of the type described above is known from U.S. Pat. No. 4,141,373, although it is directed only at the deoiling of scrap. To improve the heat transfer from an internal heat source to the parts during the heat-up and evaporation phases, inert gas is supplied continuously and conducted in a circuit through a condenser and a vacuum pump and/or expelled to the atmosphere. The temperature range specified for this process is from 65° C. to 593° C., and the pressure range is from 654 mbar to 691 mbar (during heat-up), extending down to a minimum of 173 mbar (during the main oil evaporation phase). The oil evaporates from the very start at a rate which increases with temperature.

When the gas is exhausted continuously into the atmosphere, the process leads to the consumption of large amounts of inert gas; but when the gas is conducted around a circuit, it is still necessary for large amounts of energy to be consumed, because the hot gas is also cooled along with the oil vapors in the condenser and must therefore be continuously reheated. One reason that this is so is that the connection between the vacuum furnace and the condenser cannot be broken, which means that a continuous energy gradient is present with respect to the condenser. It is possible to deoil a mixture of oil and inert gas continuously only by means of very large heat-exchange or condensation surfaces. A very large amount of energy is wasted regardless of whether a once-through or a closed-circuit process is used.

This is probably also the reason that the heat-up period is stated as 5.5 hours, even though the final temperature is still only 371° C. or 343° C. After the heat-up period and at the beginning the main oil evaporation phase, it is true that the feed of inert gas is decreased by half, but it is not completely interrupted. The open process is necessary even if only for the reason that otherwise, at the high final temperatures, the vapor pressure of most of the oils in question are considerably greater than atmospheric pressure. At these high final temperatures, however, thermal damage to most of these oils is unavoidable, which excludes the possibility of their reuse.

Insofar as the parts in question are workpieces for machine-building, temperatures on this high level are also harmful to most workpieces, because the temperatures are, for example, above the conventional tempering temperature of hardened workpieces, especially when the workpieces in question are case-hardened.

Because of the indicated course of the pressure and temperature, the high pressure also leads unavoidably into the range below the associated vapor pressure curve, with the result that any oil which has accumulated on or in the parts will start to boil. The leads to the formation of heat sinks and irregular temperature zones, which cannot be equalized again except by long processing times.

U.S. Pat. No. 4,141,373 also states that the use of inert gas can be omitted if the scrap is heated by electric contact heaters. This measure, however, is completely unsuitable for the heating of packings of workpieces, because it results in highly uneven temperatures, which can be tolerated only in the deoiling of scrap.

U.S. Pat. No. 5,401,321 discloses heating structural parts for machinery to 2000° C. and reducing the pressure to 10 hPa (10 mbar) as a way of bringing about a deoiling or degreasing without any transition between the two phases. The patent does not disclose the flooding of the furnace with inert gas to shorten the heating time.

DE 44 15 093 discloses heating scrap carrying certain amounts of organic substances such as used oils to temperatures of up to 4500° C. and lowering the pressure to $10^{-3}$ mbar as a way of opening closed scrap parts, for example, and deoiling them without any transition between the two phases. Flooding with inert gas to shorten the heating time is not disclosed.

JP Patent 5-78,875 describes the deoiling of parts in a nitrogen atmosphere first and then in high-pressure, superheated steam. The process is complicated, and a corresponding amount of condensed water is obtained, which must be separated from the oil which has also condensed.

SUMMARY OF THE INVENTION

The invention provides a vacuum process by means of which even temperature-sensitive workpieces, of relatively high density, especially case-hardened workpieces, can be uniformly heated in the shortest possible time to a temperature at which deoiling can be achieved by means of a relatively sharp drop in pressure, specifically to a temperature which is also already in the range of the temperatures to be used in a following processing step.

According to the invention, the following process parameters apply:

(a) the second pressure is above the vapor pressure curve of the wetting oil and is adjusted by flooding the vacuum furnace;

(b) the inert gas feed and the evacuation are interrupted after the flooding, and, during the heat-up period, the inert gas together with the oil vapors which have formed are circulated over the parts exclusively in the interior of the vacuum furnace until the parts have reached a predefined final temperature; and (c) upon completion of the heat-up period, a connection from the vacuum furnace to the condenser and to the vacuum pump is established, and the pressure is lowered to a value which is under the vapor pressure curve, so that the oils thus induced to evaporate can be withdrawn and condensed.

The term "flooding" is understood here to mean a single filling of the vacuum furnace with the gas in question, not a continuous gas feed from the outside. After the flooding and until the furnace is evacuated again, the atmosphere is therefore closed off from the outside and has its own internal circulation.

As a result of the flooding of the vacuum furnace with inert gas to a pressure which is significantly higher than the initial pressure in the vacuum furnace and which can be, for example, in the range of 500–1,000 mbar, and as a result of the circulation of the inert gas over and through the parts and the heat source in a closed circuit inside the sealed-off vacuum furnace, it is possible to heat up the parts at a much faster rate than can be achieved in the prior processes of the general type in question. Because the appropriately heated inert gas, containing continuously increasing amounts of evaporated oil is circulated, it is possible not only for the parts batch but also the interior surfaces of the vacuum furnace, onto which the released vapors could otherwise condense, to be heated much more rapidly. During the heat-up phase under inert gas, the oils do not evaporate at first as a result of boiling. This type of evaporation does not start until the pressure has been reduced to a value which is below the vapor pressure curve. At this point, the oil starts to evaporate almost instantaneously, and these vapors can then be condensed, collected almost quantitatively, and recovered.

As a result, both the consumption of inert gas and the consumption of energy are reduced considerably below the values known from the state of the art, because the inert gas does not have to be reheated continuously from the temperature in the condenser to a temperature suitable for heating the work-pieces.

In addition, the inert gas is exhausted briefly at the beginning of the evaporation and condensation phase; it is not circulated continuously through the condenser. As a result, the size of the condensation surfaces required is much smaller;for example, they need to be only one-tenth the size of the condensation surfaces used in the process according to the state of the art.

The evaporation process is especially intense when the pressure after the completion of the heat-up period is lowered to a value below 100 mbar, preferably below 10 mbar, to evaporate the oils.

To protect the parts, it is especially advantageous for the heat-up period to end at a temperature of no more than 350° C., and preferably of no more than 300° C.

A vacuum cleaning process such as this can be integrated easily into a manufacturing process. As a result, metal workpieces, for example, are freed of all traces of quenching oils and cooling lubricants. Neither alkaline solutions nor solvents of the type described above are required to clean the parts. Expensive workup processes are no longer needed, and only extremely small amounts of gas escape to the outside air via the vacuum pumps. A condenser is connected upline from these vacuum pumps, however, to condense the small amounts of oil vapors which are released.

As part of an additional embodiment for the tempering of parts wetted with a quenching oil, the vacuum furnace is first flooded to heat up and clean the parts to a pressure which is above the evaporation pressure of the quenching oil in question at the tempering temperature of the workpiece material to be used later. After this tempering temperature has been reached, the total pressure is lowered again and is kept lowered until at least most of the quenching oil has evaporated and the tempering process is over.

As a result of this process, the removal of the quenching oil from the workpieces and the tempering process can be carried out in the same vacuum, one immediately after the other, without any interruption. The deoiling and the tempering processes pass almost seamlessly into each other, as a result of which an enormous amount of time is saved within the manufacturing process. In this case there is no need to install either any preliminary or intermediate cleaning units.

When components wetted with oil-in-water emulsions are being cleaned, it is especially advantageous:

(a) to eliminate most of the residual air by initially lowering the pressure to a value which is above the vapor pressure curve of water;

(b) in a following step of the process, to accelerate the heating of the components by flooding the vacuum furnace with an inert gas to a pressure which is above the vapor pressure curve of water and by circulating the inert gas; and to evaporate the water by lowering the total pressure to a value which is below the vapor pressure curve of the water but above the vapor pressure curve of the oil; and (c) in a another step of the process, to accelerate the heating of the parts by flooding the vacuum furnace again with an inert gas to a pressure which is above the vapor pressure curve of the oil and by circulating the inert gas; and to evaporate the oil by lowering the total pressure to a value which is below the vapor pressure curve of the oil.

As a result of this measure, it is possible to separate at least most of the oil from the water and also to collect the two media in the form of separate condensates. It is only during process step (b) that a small amount of oil vapor will pass together with the water vapor into the condensate, the exact amount depending on the partial pressure relationships.

Two exemplary embodiments of the invention will be described.

DETAILED DESCRIPTION OF THE PREFERRED EMBODIMENTS

Figure 1:
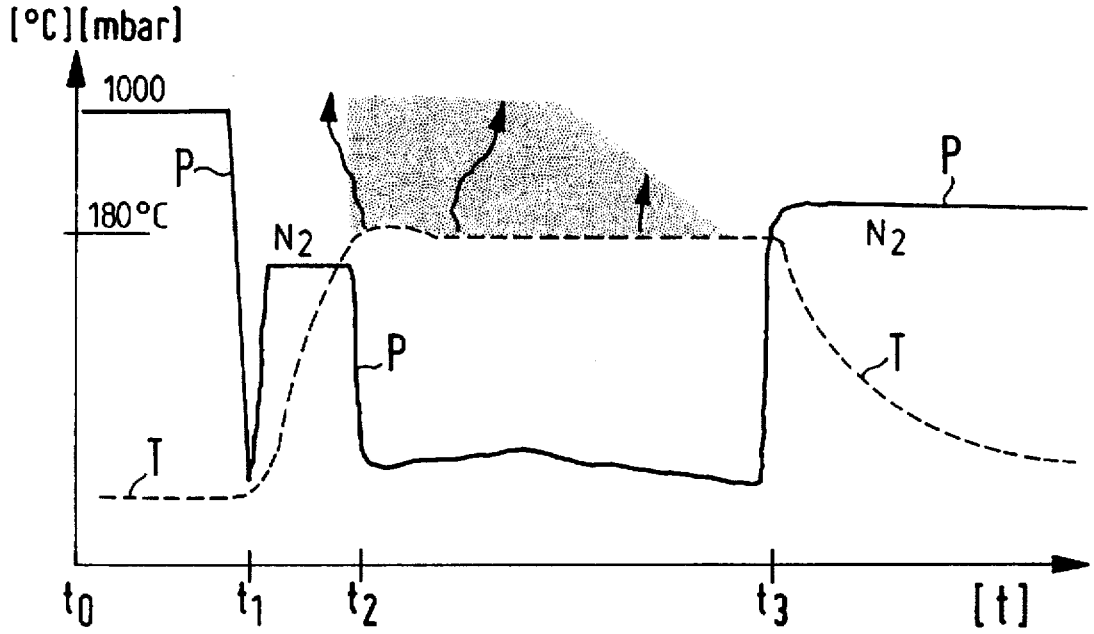
FIG. 1 shows a diagram of a combined cleaning and tempering process as it occurs over the course of time.

In FIG. 1, time is plotted without a scale on the abscissa; the pressure and temperature are plotted on the ordinate. The change in pressure is characterized by a solid line, the change in temperature by a broken line. The individual process parameters can be derived from Example 1, described below. It can be seen that, within time span $t_1$–$t_2$ of 45 minutes, the tempering temperature of 180° C. is reached at a heating power of 90 kW. After this heating period, the pressure is quickly lowered at time $t_2$. The stream of oil vapor forming at this point is indicated symbolically by the dotted field and the arrows. At time $t_3$, i.e., after a period of another 120 minutes, both the cleaning process and the tempering process are over.

Figure 2:
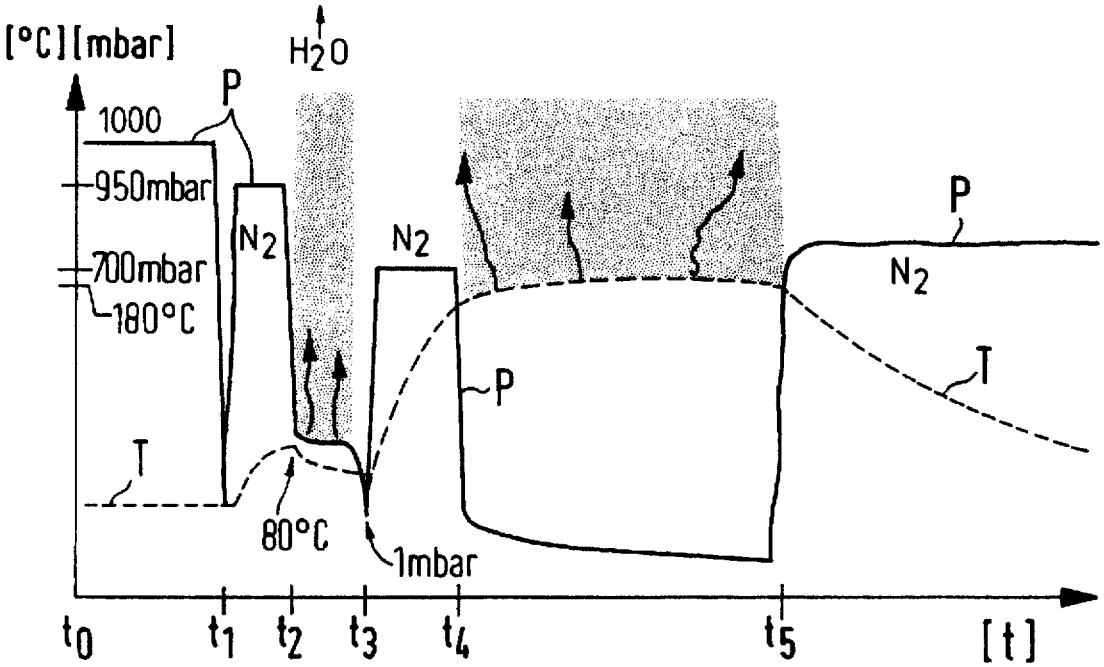
FIG. 2 shows a diagram of the course of the evaporation of water and oil as a preliminary stage of a hardening process.

FIG. 2 shows the course of the process according to Example 2. With respect to the individual process parameters, reference is made to Example 2. At time $t_1$, the vacuum furnace is evacuated to a pressure of 25 mbar, and it is then immediately flooded to a pressure of 950 mbar by the introduction of nitrogen. The diagram shows that, during this time span of $t_{1-t2}$, the workpiece temperature quickly reaches a value of 80° C. During this phase of the operation, the heating is rapid, but little or no water evaporates. By lowering the pressure in operating phase $t_2$–$t_3$, a pressure of 120 mbar is reached initially, at which the water is evaporated very quickly at the indicated workpiece temperature of 80° C. This process is indicated symbolically by the arrows and the dotted field. The small drop in temperature is attributable to the removal of the heat of evaporation. The end of the water evaporation phase is marked by a steep drop in pressure to a value of approximately 1 mbar as the vacuum pumps keep running. At this point, it is necessary to heat the workpieces or structural parts back up again to evaporate the oil remaining from the emulsion. For this purpose, the vacuum furnace is flooded with nitrogen again to a pressure of 700 mbar within the time span $t_3$–$t_4$. It can be seen that, during this phase of the operation, during which the nitrogen is conducted through a heating device by a blower, a steep temperature rise is obtained inside the batch, as indicated by the broken line. During time span $t_3$–$t_4$, there is no significant evaporation of oil. The oil begins to evaporate almost instantaneously, however, when the pressure of 700 mbar in the vacuum furnace is rapidly lowered to 0.1 mbar at time $t_4$. The stream of oil vapor is symbolized by the arrows and the dotted field. Shortly before time $t_5$, the evaporation of the oil ends; the workpieces are therefore clean and dry now and can be sent on to a hardening process, in which they are heated and quenched with a quenching oil. Parts which have been hardened in this way can then be cleaned again according to the operating diagram of FIG. 1.

Figure 3:
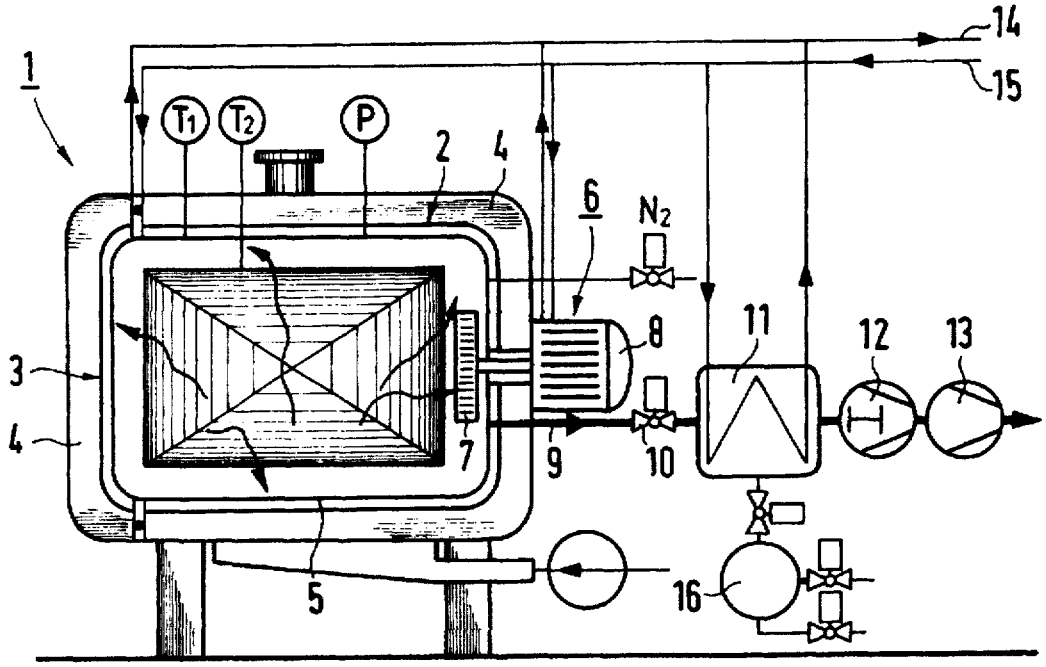
FIG. 3 shows a vertical cross section through a vacuum furnace in conjunction with a flow chart for generating the various process parameters.

FIG. 3 shows a vacuum furnace 1, which consists of a furnace chamber 2 and a door 3, both of which are surrounded by thermal insulation 4. Inside the vacuum furnace there is radiation shielding 5. The furnace atmosphere can be circulated by a blower 6, which consists of a fan wheel 7 and a drive motor 8. The heating device, through which the furnace atmosphere is conducted in a circuit, is not shown for the sake of simplicity. It is installed in the form of a heating resistor between thermal insulation 4 and furnace chamber 2, the interior surface of which thus becomes the heat-exchange surface. Temperature sensors $T_1$, and $T_2$ are used to monitor and possibly to regulate the wall temperature of the vacuum furnace and of the batch; the pressure of the furnace atmosphere is measured and possibly controlled by a pressure sensor P.

A vacuum line 9, in which a shut-off valve 10 is installed, leads to a condenser 11, to which two vacuum pumps 12, 13 are connected. Condenser 11 is connected to a coolant circuit, of which only the two lines 14, 15 are shown here, to which vacuum furnace 1 and motor 8 are also connected. A receiver 16 is provided to collect the condensate or condensates. The individual associated shut-off valves have not been given reference numbers for the sake of simplicity.

Shut-off valve 10 is important for the rapid heating of the parts. It is closed after the evacuation step and before the flooding with the inert gas source $N_2$ (nitrogen) and remains closed throughout the entire heating period, so that, during this/these time(s), it is impossible for any pressure or temperature gradient to develop with respect to condenser 11. It is opened again only to allow the pressure to be lowered quickly to a value below the vapor pressure curve(s) in question. Thus the limited amount of inert gas which has been used to flood the furnace is quickly drawn out, and then the evaporation of the condensable components by boiling can be guided to an end without any inert gas feed. No external circuit for the continuous return of the inert gas into furnace chamber 2 is provided. Condenser 11 and the quantity of heat dissipated therein can thus be kept very small.

Figure 4:
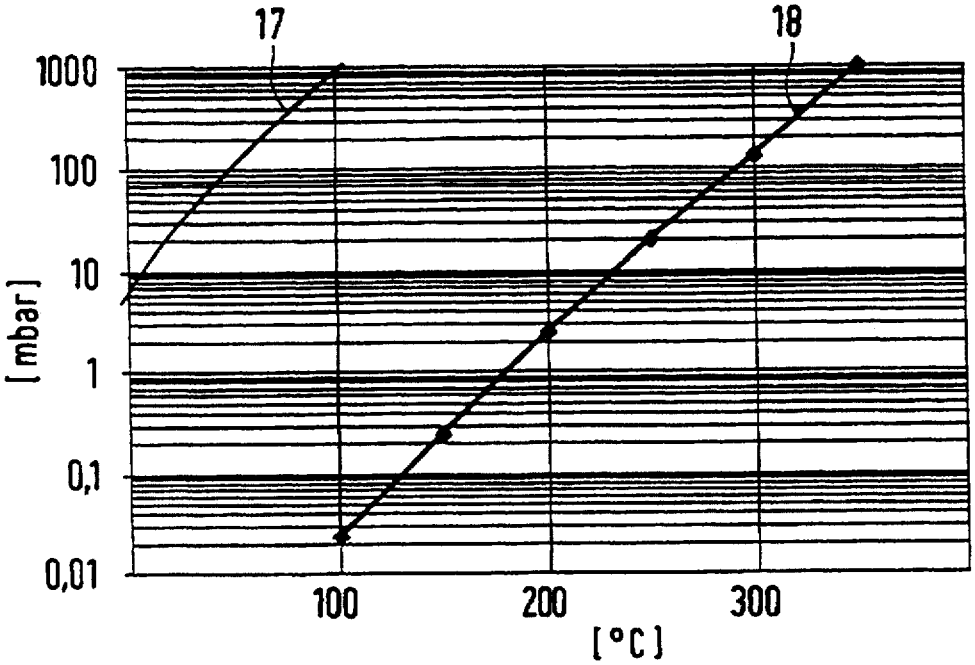
FIG. 4 shows a diagram with the vapor pressure values for water and quenching oil.

FIG. 4 shows a diagram in which the temperature is plotted in °C. on the abscissa and the pressure in mbar on the ordinate. Curve 17 characterizes the thermodynamic data for water, whereas curve 18 represents the thermodynamic data for a possible quenching oil. No significant amount of evaporation of the fluid in question occurs in the fields located above and to the left of the curves; the parameters for the evaporation of the fluid in question are to be found in the fields located below and to the right of the curves. FIG. 4 serves especially to illustrate the operating conditions in the patent claims and in the examples.

EXAMPLE 1

The quenching oil was allowed to drip off gear wheels of alloy 16MnCr5, which had been hardened by quenching in oil. The total weight of the wheels was 400 kg, and they were at room temperature. The gear wheels were placed in a basket and introduced into the system shown in FIG. 3 for tempering. The vacuum chamber furnace of this system had an interior volume of 2.4 $m^3$. The furnace was first evacuated to a vacuum of 4 mbar without a nitrogen feed. Then shutoff valve 10 was closed, and the furnace was immediately flooded with nitrogen to a pressure of 700 mbar. The nitrogen feed was then turned off. With shutoff valve 10 closed, the nitrogen was circulated by the blower around the interior of the furnace chamber and over the furnace heating device and the gear wheels. The heating power was 90 kW. The tempering temperature of 180° C. was reached in about 45 minutes. At this temperature, the vapor pressure of the quenching oil was 1 mbar; that is, the nitrogen pressure was considerably above this vapor pressure, so that there was no significant amount of evaporation of the quenching oil as a result of boiling. As a result of the circulation of the closed-off furnace atmosphere containing small but increasing amounts of oil, an extremely uniform batch temperature was achieved. Shutoff valve 10 was now opened, and the furnace was evacuated to a pressure of 0.1 mbar, which was under the indicated vapor pressure of the quenching oil at the gear wheel temperature, with the result that the oil began to boil and thus to evaporate. After a period of 120 minutes, the heating phase was ended; the furnace was flooded with nitrogen; and the gear wheels were cooled. The gear wheels were dry, and 9,800 g of quenching oil had been collected as reusable condensate.

EXAMPLE 2

Gear wheels of the alloy 16MnCr5 with a total weight of 400 kg, at room temperature, were wet with a water-oil emulsion, which had been used as a coolant. After the emulsion had been allowed to drip off, the wheels were placed in a basket and introduced into the system illustrated in FIG. 3, the vacuum chamber furnace of which had an interior volume of 2.4 $m^3$. The furnace was first evacuated to a vacuum of 25 mbar, at which point shutoff valve 10 was closed. The furnace was then immediately flooded with nitrogen to a pressure of 950 mbar, and then the nitrogen feed was turned off. The nitrogen was circulated by the blower over the heating device of the furnace and over the gear wheels at a heating power of 90 kW. A temperature of 80° C. was reached. At this temperature, the vapor pressure of the water was 473 mbar; that is, the nitrogen pressure was above this vapor pressure, with the result that there was no observable evaporation of the water. Shutoff valve 10 was then opened again, and the furnace was now evacuated to a pressure of 120 mbar, which was under the above-cited vapor pressure of the water at the gear wheel temperature. As a result, the water but not the oil of the emulsion began to evaporate. As a result of the removal of the heat of evaporation of the water, the temperature of the gear wheels decreased slightly. Overall, 1,800 g of water was collected as condensate within a span of 10 minutes. Then the furnace was evacuated to a pressure of 1 mbar to remove all of the water vapor from the furnace.

After the water had evaporated and shutoff valve 10 was closed, nitrogen was again introduced into the furnace to a pressure of 700 mbar. Then the nitrogen feed was turned off, and the nitrogen was circulated over the gear wheels in a closed, internal circuit by means of the blower under continuation of the heating at the same output until the gear wheels reached a temperature of 180° C., which took 30 minutes. At this point the vapor pressure of the oil was 1 mbar, which was below the pressure of the nitrogen. As a result, there was no noticeable evaporation of the oil as a result of boiling. After this temperature was reached, shutoff valve 10 was opened again, and the furnace was evacuated to a pressure of 0.1 mbar, which was under the vapor pressure of the oil. The oil immediately started to evaporate. After 120 minutes, the heating was ended; the furnace was flooded with nitrogen; and the gear wheels were cooled. The gear wheels were dry, and 160 g of oil was obtained as reusable condensate. The gear wheels dried in this way were then heated to hardening temperature, quenched with a quenching oil, and freed of quenching oil and tempered in accordance with the process of Example 1.

What is claimed is:

1. Process for the cleaning of oil-wetted structural parts in a vacuum furnace, which is first evacuated to a predefined first pressure by means of a vacuum pump to eliminate as much of the residual air as possible, and into which, to accelerate the heating of the structural parts, an inert gas is introduced until a second, subatmospheric pressure is reached, which is above the first pressure, where, the inert gas is circulated over the parts and a heat source and thereafter the pressure is lowered to a value which is under the vapor pressure curve of the oil, with the result that the oils are evaporated and the evaporated oils are evacuated via a connection to a condenser and condensed in said condenser, wherein (a) the second pressure is selected to be above the vapor pressure curve of the wetting oil and is reached by the flooding of the vacuum furnace;

(b) the inert gas feed and the connection to the condenser are interrupted after the flooding, and the inert gas and the oil vapors which have formed are conducted over the parts exclusively in the interior of the vacuum furnace within the course of a heating period until a predetermined final temperature of the parts is reached; and in that (c) at the end of the heating period, the connection is opened from the vacuum furnace to the condenser and to the vacuum pump; the pressure is lowered to value which is below the vapor pressure curve; and the oils are evaporated and withdrawn and condensed.

2. Process according to claim 1, characterized in that, after the end of the heating period, the pressure is lowered to a value of 100 mar, preferably to a value of less than 10 mbar, to evaporate the oils.

3. Process according to claim 1, characterized in that the heating period is ended at a temperature of no more than 350° C., and preferably of no more than 300° C.

4. Process according to claim 1, characterized in that, for the tempering of structural parts wetted by a quenching oil, the vacuum furnace (1) is flooded for the heating and cleaning of the components to a pressure which is above the evaporation pressure of the quenching oil in question at the tempering temperature to be used later, and in that, after this tempering temperature has been reached, the total pressure is lowered again and kept lowered until at least most of the quenching oil has evaporated and the tempering pro- cess is ended.

5. Process according to claim 1, characterized in that, for the cleaning of structural parts which are wetted with oil-water emulsions, (a) the initial pressure reduction for eliminating most of the residual air proceeds to a value which is above the vapor pressure curve of the water;

(b) in a following process step for accelerating the heating-up of the structural parts, the vacuum furnace is flooded with an inert gas to a pressure which is above the vapor pressure curve of water; the inert gas is circulated; and, to evaporate the water, the total pressure is lowered to a value which is below the vapor pressure curve of water but above the vapor pressure curve of the oil; and (c) in a further process step for additionally accelerating the heating of the structural parts, the vacuum furnace is again flooded with an inert gas to a pressure which is above the vapor pressure curve of the oil; the inert gas is circulated; and, to evaporate the oil, the total pressure is lowered to a value which is below the vapor pressure curve of the oil.

* * * * *

UNITED STATES PATENT AND TRADEMARK OFFICE

CERTIFICATE OF CORRECTION

PATENT NO. : 5,762,717
DATED : June 9, 1998
INVENTOR(S) : Hugo, et. al.

It is certified that error appears in the above-identified patent and that said Letters Patent is hereby corrected as shown below:

In column 2, line 51, change "2000 °C" to read as "200 °C".
In column 2, line 58, change "4500 °C" to read as "400 °C".
In column 3, line 65, change "smaller;for" to read as "smaller; for".
In column 8, line 41, change "pro- cess" to read as "process".

Signed and Sealed this

Twenty-sixth Day of December, 2000

*Attest:*

Q. TODD DICKINSON

*Attesting Officer*

*Director of Patents and Trademarks*